United States Patent [19]

Hamburg

[11] Patent Number: 4,664,087

[45] Date of Patent: May 12, 1987

[54] VARIABLE RATE PURGE CONTROL FOR REFUELING VAPOR RECOVERY SYSTEM

[75] Inventor: Douglas R. Hamburg, Birmingham, Mich.

[73] Assignee: Ford Motor Company, Dearborn, Mich.

[21] Appl. No.: 756,546

[22] Filed: Jul. 19, 1985

[51] Int. Cl.[4] ..... F02M 25/08

[52] U.S. Cl. ..... 123/520; 123/489

[58] Field of Search ..... 123/520, 519, 518, 521, 123/440, 489, 589

[56] References Cited

U.S. PATENT DOCUMENTS

| | | | |
|---|---|---|---|
| 3,831,353 | 8/1974 | Toth | 55/387 |
| 3,963,009 | 6/1976 | Mennesson | 123/440 |
| 4,013,054 | 3/1977 | Balsley et al. | 123/519 |
| 4,275,697 | 6/1981 | Stoltman | 123/520 |
| 4,308,842 | 1/1982 | Watanabe et al. | 123/520 |
| 4,318,383 | 3/1982 | Iritani et al. | 123/520 |
| 4,326,489 | 4/1982 | Heitert | 123/520 |
| 4,377,142 | 3/1983 | Otsuka et al. | 123/440 |

FOREIGN PATENT DOCUMENTS

| | | | |
|---|---|---|---|
| 57-86555 | 5/1982 | Japan | 123/519 X |
| 58-131343 | 8/1983 | Japan | 123/519 X |
| 58-185966 | 10/1983 | Japan | 123/520 |

*Primary Examiner*—Andrew M. Dolinar

*Attorney, Agent, or Firm*—Allan J. Lippa; Peter Abolins

[57] ABSTRACT

Purging of fuel vapors from a vapor canister storing fuel vapors from the fuel tank of an internal combustion engine is done by modulating the overall purge flow rate from the vapor canister as a function of the amount of fuel vapor stored in the vapor canister.

6 Claims, 5 Drawing Figures

OPEN LOOP, FAST PURGE
CANISTER EMPTY
CANISTER FULLY CHARGED
SIMULATED AIR/FUEL RATIO
20.0
18.7
17.5
16.3
15.0
13.8
12.5
11.3
10.0
5.00
7.50
10.0
12.5
15.0
17.5
20.0
TIME (H SEC.)
PURGE SIGNAL
START PURGE
END PURGE

VARIABLE RATE PURGE CONTROL FOR REFUELING VAPOR RECOVERY SYSTEM

BACKGROUND OF THE INVENTION

1. Field of the Invention

This invention relates to a control device for variably controlling a purge of fuel vapors from a storage canister into an automotive type internal combustion engine.

2. Prior Art

Carbon canister storage systems are known for storing fuel vapors emitted from an automotive-type fuel tank to prevent emission into the atmosphere of evaporative fuel components. These systems usually include a canister containing activated carbon with an inlet from the fuel tank or other reservoir. When the fuel vaporizes, the vapors will flow either by gravity or under vapor pressure into the canister to be adsorbed by the carbon inside. Filling the fuel tank with fuel may displace fuel vapors in the fuel tank and drive them into the canister. Subsequently, in most instances, the purge line connected from the canister outlet to the carburetor or engine intake manifold purges the stored vapors into the engine during engine operation. The canister contains a purge fresh air inlet to cause a sweep of the air across the carbon particles to thereby desorb the carbon of the fuel vapors.

In most instances, a purge or nonpurge of vapors is an on/off type of operation. That is, either the purge flow is total or zero. For example, U.S. Pat. No. 3,831,353 to Toth teaches a fuel evaporative control system and associated canister for storing fuel vapors and subsequently purging them back into the engine air cleaner. However, there is no control valve mechanism to vary the quantity of purge flow. As soon as the throttle valve is open, the fuel vapors are purged continuously into the manifold.

U.S. Pat. No. 4,326,489 to Heitert teaches a fuel vapor purge control device that controls a vacuum servo mechanism connected to a valve member that is slidable across a metering slot to provide a variable flow area responsive to changes in engine intake manifold vacuum to accurately meter the re-entry of fuel vapors into the engine proportionate to engine airflow.

U.S. Pat. Nos. 4,013,054; 4,275,697; 4,308,842; 4,326,489 and 4,377,142 disclose fuel purging systems incorporating some form of air/fuel ratio control but include no provision for applying a sequence of time varying pulses to the solenoid purge control valve.

As described, typical onboard refueling vapor recovery systems use an activated carbon canister to store the gasoline vapors which are displaced when refueling of the vehicle is performed. These vapors are subsequently purged from the system by passing air through the canister and into the engine, thereby causing a potential enrichment of the engine's air/fuel ratio and an increase in the engine's emissions, such as carbon monoxide and hydrocarbon. Such undesirable effects of purging can be reduced with present day fuel systems which employ feedback from an EGO sensor in the engine's exhaust to regulate the air/fuel ratio. Unfortunately, air/fuel ratio feedback cannot instantaneously reduce the air/fuel perturbations which result from abrupt changes in purging because of the inherent propagation time delay through the engine and exhaust system. As a result, there will always be short periods of uncontrolled air/fuel perturbations whenever the refueling vapor purge flow changes abruptly, such as at the beginning or end of a purge command signal. An abrupt increase of a vapor filled purge, such as that from a vapor filled canister, can cause an undesirably rich air/fuel ratio. On the other hand, an abrupt decrease with a substantially air filled purge, such as that from a vapor free canister, can also cause an undesirably rich air/fuel ratio.

It would be desirable to eliminate uncontrolled air/fuel perturbations whenever the refueling vapor purge flow changes abruptly. These are some of the problems this invention overcomes.

SUMMARY OF THE INVENTION

In accordance with an embodiment of this invention, air/fuel ratio perturbations due to fuel vapor purging are reduced by controlling the vapor canister purge rate as a variable function of the charge of the fuel vapor in the vapor canister. This avoids excessive air/fuel perturbations. One way of determining the canister charge level is to use the gasoline level in the vehicle's fuel tank.

The performance of a fuel control system using feedback from an exhaust gas oxygen sensor in the engine's exhaust is dependent upon the amount of gasoline vapors purged from the canister as well as on the amount of air being used for the purge. For example, when the vehicle has just been refueled, the canister will be fully charged and the resulting rich air/fuel perturbations associated with purging will be so extensive that complete correction of the perturbations using air/fuel feedback is practically precluded. As the vehicle is driven, the canister will become more depleted to the point that the air/fuel perturbations associated with purging will be negligible because the air/fuel in the purge line will be approximately the same as the normal air/fuel ratio that would exist with no purging. Additional driving will result in further depletion of the canister charge and again causing air/fuel ratio perturbations during purging.

In accordance with this invention, when a fuel tank is full, as indicated by the output from a fuel gauge sending unit in the tank, the purge rate would be set to a reduced value of the maximum purge rate in order to reduce the severity of the purge-induced rich air/fuel ratio perturbations. Then, as the fuel level in the tank drops, the purge flow rate would be gradually increased as a function of the fuel gauge sender output until the purge rate reaches its maximum value and the canister is sufficiently depleted so that the purge air/fuel ratio is nearly equal to the engine air/fuel ratio. Finally, as the fuel level drops, further indicating that the canister is nearing complete depletion, the purge flow rate is gradually set to a reduced value of the maximum purge flow rate in order to reduce the severity of the purge-induced lean air/fuel perturbations.

DETAILED DESCRIPTION OF THE INVENTION

Figure 1:
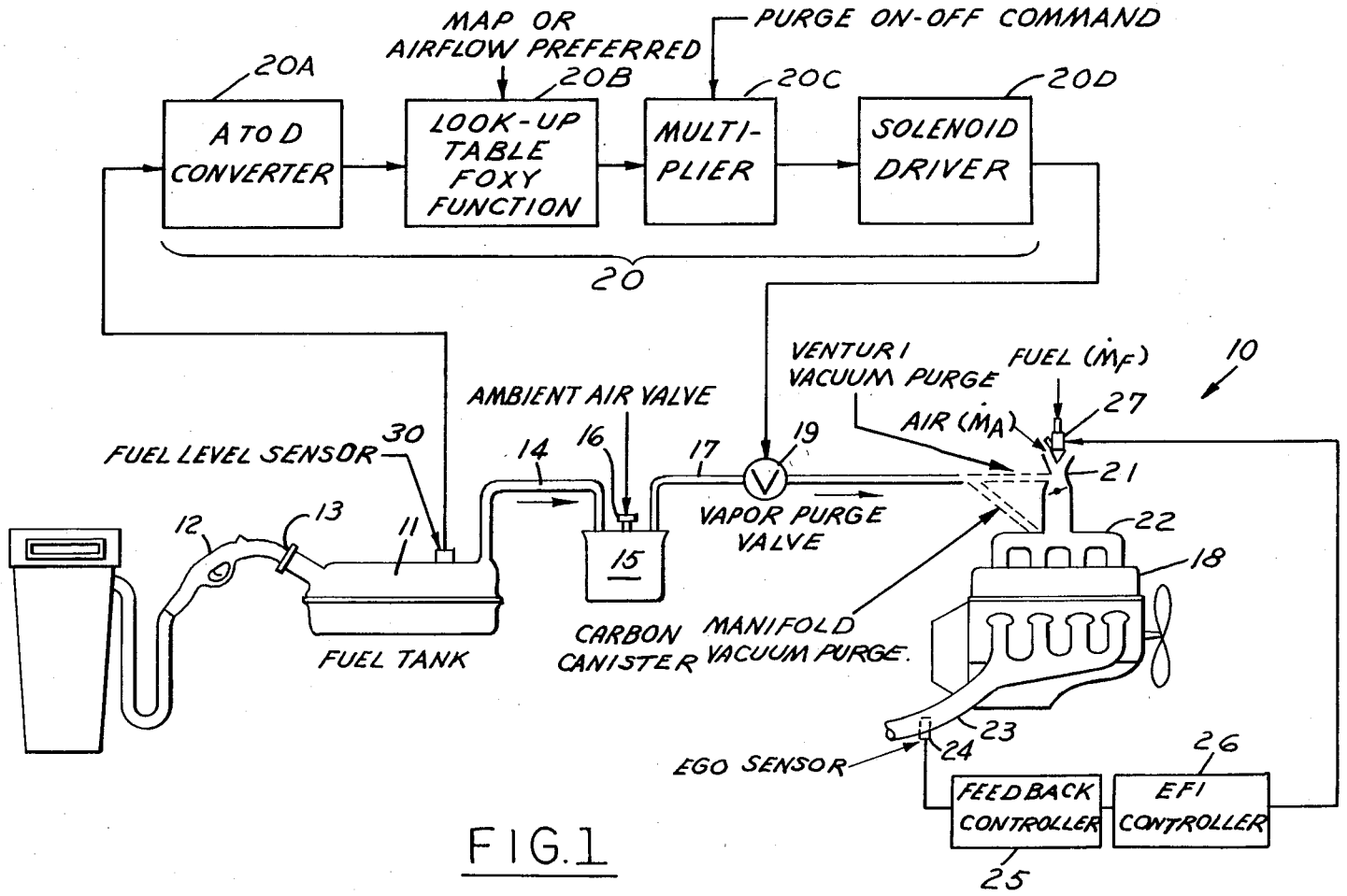
FIG. 1 is a block diagram of a refueling vapor recovery system in accordance with an embodiment of this invention.

Referring to FIG. 1, a refueling vapor recovery system 10 includes a fuel tank 11 which is coupled to a fuel filling nozzle 12 through a gas tight seal 13. Fuel vapors from fuel tank 11 pass through a conduit 14 to a carbon canister 15. Carbon canister 15 has an ambient air valve 16 for communicating the ambient air into carbon canister 15. Ambient air valve 16 receives air during purging and vents air during refueling. A conduit 17 extends from carbon canister 15 to the intake of an engine 18. A vapor purge solenoid and valve 19 is positioned in conduit 17 to control the flow of vapor purge to engine 18. A valve control actuator system 20 is coupled to vapor purge valve 19 to control the opening and closing of valve 19. A fuel level sensor 30 is coupled to the input of valve control actuator system 20. Conduit 17 can be connected to either a throttle intake 21 of engine 18 or to an intake manifold 22 of engine 18. An exhaust manifold 23 of engine 18 supports exhaust gas oxygen sensor 24. A signal from exhaust gas oxygen sensor 24 is applied to a feedback controller 25 which in turn applies a signal to an electronic fuel injection controller 26 which controls a fuel injector 27 to introduce fuel into engine 18.

Valve control actuator 20 includes the serial combination of an analog to digital converter 20A, a lookup table 20B, a multiplier 20C, and a solenoid driver 20D. Lookup table 20B has an additional input of a signal representative of air flow such as air flow or the manifold absolute pressure. Multiplier 20C has an additional input of a purge on-off command.

Figure 2:
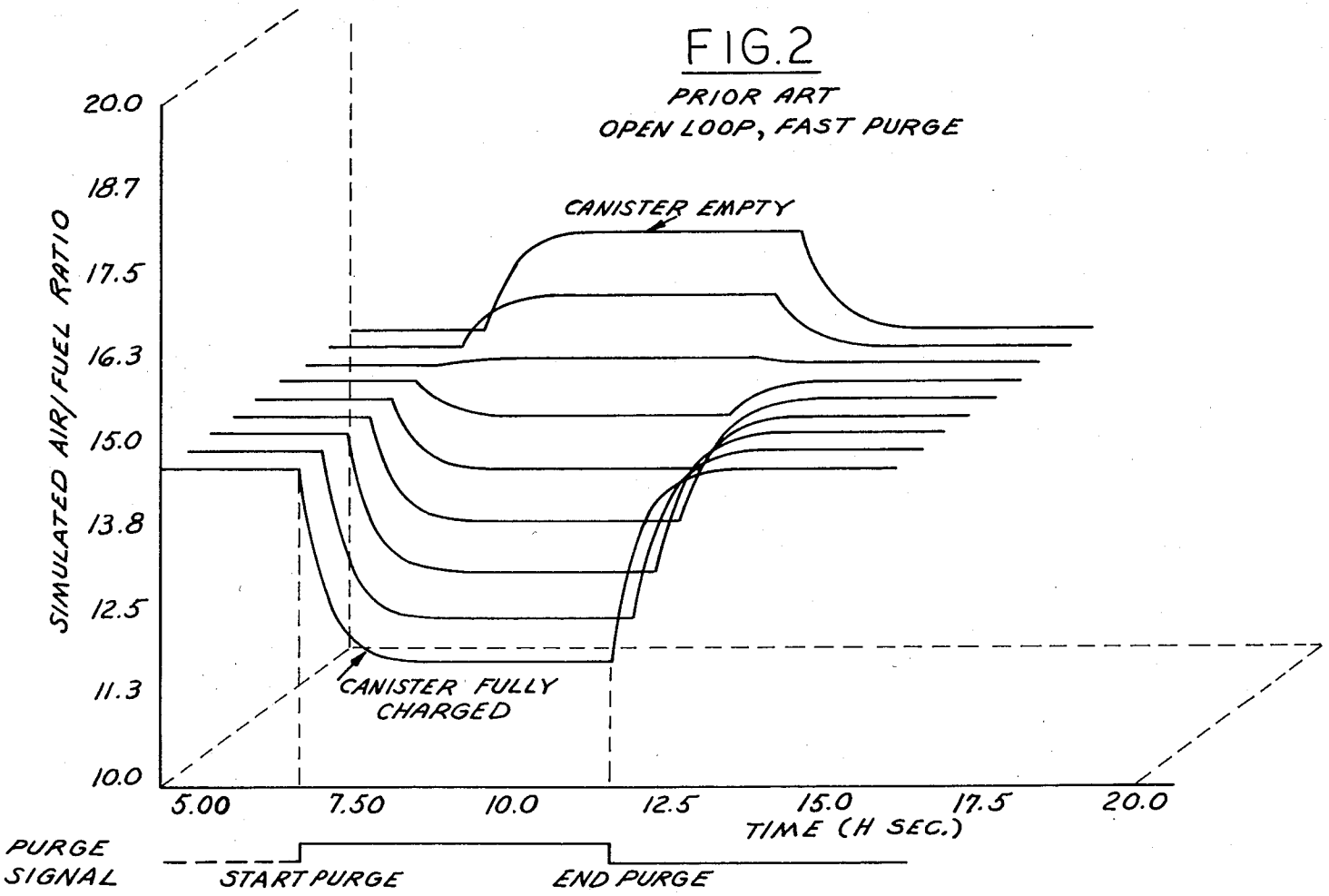
FIG. 2 PRIOR ART
FIG. 2 is a graphical representation of air/fuel ratio versus time during the purging of a vapor canister for different charge states of a canister ranging from a fully charged canister to an empty canister using an open loop air/fuel ratio control system in accordance with the prior art.

Referring to FIG. 2, a prior art open loop system with a fast purge causes a shift in the air/fuel ratio depending upon the condition of the canister. That is, when the canister is fully charged of fuel vapor, the start of a fast purge produces a rapidly decreasing air/fuel ratio because of the introduction of additional fuel vapor. At the end of the purge, the air/fuel ratio rises back to its pre-purged value. The corresponding curves for decreasing amounts of fuel vapor in the canister are shown. When the air/fuel ratio in canister itself, that is, the ratio of air drawn in through ambient air valve 16 to the fuel vapor in canister 15; is substantially the same as the starting air/fuel ratio of the engine system, the air/fuel ratio stays constant throughout the purge. If the canister is substantially empty of fuel vapor, purging the canister causes the introduction of air into the intake of the engine and increases the air/fuel ratio from that present before the start of the purge.

Figure 3:
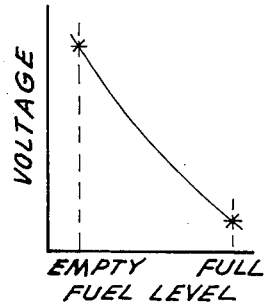
FIG. 3 is a graphical representation of voltage versus fuel level at the output of fuel level sensor 30 of FIG. 1.

Referring to FIG. 3, the output of fuel level sensor 30 typically indicates an inverse relationship between voltage and fuel level so that the voltage output gradually decreases as the fuel level increases.

Figure 4:
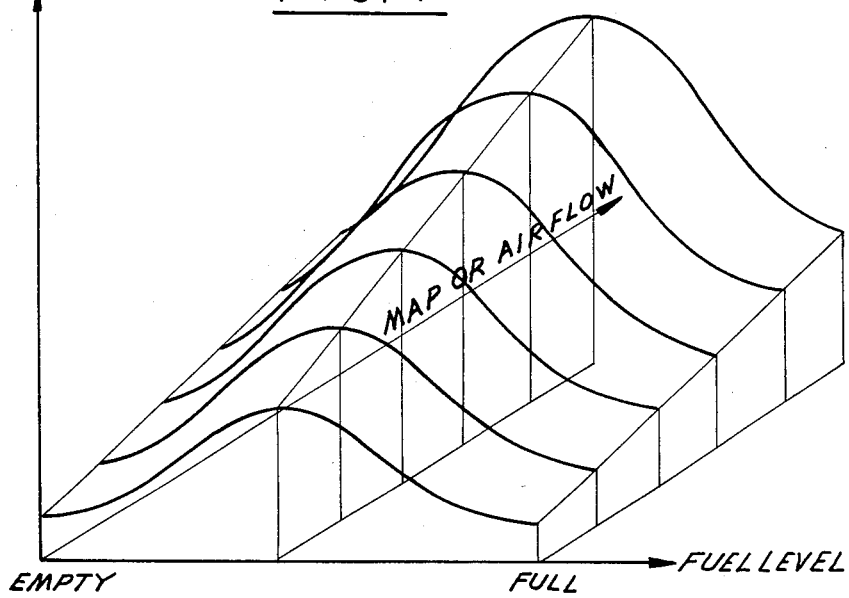
FIG. 4 is a graphical representation of the relationship of duty cycle versus fuel level as a function of air flow or manifold absolute pressure and represents a typical lookup table to be found in block 20B.
Figure 5:
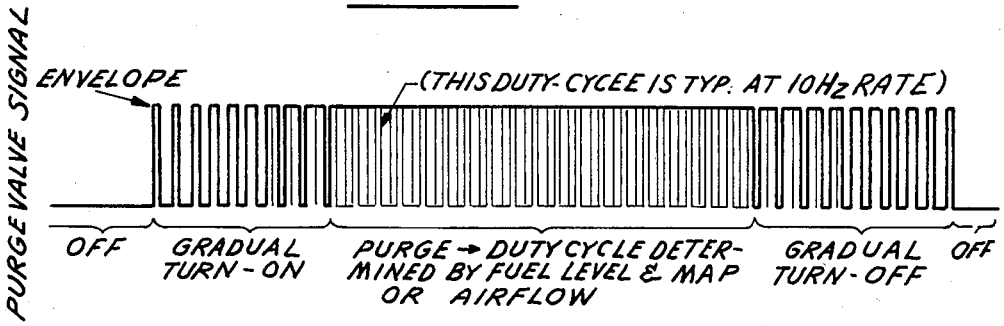
FIG. 5 is a graphical representation of the purge signal versus time at the output of solenoid driver 20D of control system 20 to be applied to purge solenoid valve 19, and including an off period, a gradual turn on period, steady-state purge period, a gradual turn off period and another off period.

Referring to FIG. 4, the graphical representation of a lookup table is shown wherein the duty cycle increases and then decreases as the fuel level goes from empty to full and the magnitude of the duty cycle generally increases with increasing air flow. Referring to FIG. 5, the graphical representation of a signal controlling a typical turn on and turn off for the purge solenoid is shown.

In operation, when fuel tank 11 is full, the purge rate is set at a reduced value of the maximum purge rate in order to reduce the severity of purge-induced rich air/fuel ratio perturbations. As the fuel level in tank 11 drops, the purge flow rate is gradually increased as a function of the fuel gauge sender output until the purge rate reaches its maximum value and the canister is sufficiently depleted so that the purge air/fuel ratio is nearly equal to the engine air/fuel ratio. As the fuel level drops further indicating the canister is nearing complete depletion, the purge flow rate is gradually set to a reduced value of the maximum purge flow rate in order to reduce the severity of the purge induced lean air/fuel perturbations.

Various modifications and variations will no doubt occur to those skilled in the arts to which this invention pertains. For example, the particular processing of the signal indicating fuel level in the fuel tank, and thus the amount of fuel vapor in the canister, may be varied from that disclosed herein. These and all other variations which basically rely on the teachings through which this disclosure has advanced the art are properly considered within the scope of this invention.

I claim:

1. A method of controlling purging of fuel vapors from a fuel canister storing fuel vapors from the fuel tank of an internal combustion engine including the steps of:
   - inducting a mixture of fuel and inlet air into the engine;
   - inducting purge air through the canister to induct a mixture of purge air and fuel vapor from the canister into the engine;
   - sensing an output parameter in the exhaust of the engine indicative of the air/fuel ratio of the engine;
   - regulating said mixture of fuel and inlet air in response to said output sensing to provide an air/fuel ratio of inlet air and purge air to fuel vapor and fuel within a predetermined range;
   - determining when the amount of fuel vapor stored in the vapor canister is above a threshold amount; and
   - limiting the purge flow of the mmixture of purge air and fuel vapor from said canister to the engine when said fuel vapor is above said threshold amount so that said regulating step is able to prevent said air/fuel ratio from exceeding said predetermined range, said limiting comprising modulating said purge flow.

2. A method of controlling purging of fuel vapors as recited in claim 1 wherein the step of determining the amount of fuel vapors stored in the vapor canister includes:
   - sensing the quantity of fuel in the vehicle fuel tank; and
   - applying the signal representing the amount of fuel in the fuel tank to a fuel control system.

3. A method of controlling purging of fuel vapors as recited in claim 2 further comprising:
   - transient modulation of the purge flow of an air and fuel vapor mixture from the vapor canister to the intake of the internal combustion engine by gradually changing the magnitude of a transient flow between no purge flow and a full purge flow so that the amount of combustion exhaust emissions can be controlled.

4. A method of controlling purging of fuel vapors as recited in claim 3 wherein the step of transient modulation includes:

placing a solenoid control valve in the flow path from the vapor canister to the intake of the internal combustion engine;

selectively actuating the solenoid control valve with pulses fully opening the solenoid control valve; and changing the duty cycle of the actuating signal applied to the solenoid control valve to gradually change the magnitude of the average flow through said solenoid control valve.

5. A method of controlling purging of fuel vapors as recited in claim 4 wherein the step of modulating the overall purge flow rate includes applying an adjustable duty cycle switching command to the solenoid purge valve to achieve the desired function between the overall purge flow rate from the vapor canister and the amount of fuel vapor stored in the vapor canister.

6. A method of controlling purging of fuel vapors as recited in claim 5 wherein the step of modulating the overall purge flow rate from the vapor canister and applying the signal representing the amount of fuel in the fuel tank includes the steps of:

applying the signal representing the amount of fuel in the fuel tank to an analog to digital signal converter;

sensing a signal indicative of airflow into the engine;

determining a desired solenoid duty cycle from a look-up table as a function of the signals representing fuel in the fuel tank and airflow into the engine;

generating a purge command indicating when purging of the canister is turned on and off; and applying the desired solenoid duty cycle to the solenoid purge valve in the presence of a purge command indicating turn on of purging.

* * * * *